US006860242B2

(12) United States Patent
Schenk

(10) Patent No.: US 6,860,242 B2
(45) Date of Patent: Mar. 1, 2005

(54) LIFT PUMP MOUNTING BRACKET FOR AN ELECTRONIC CONTROL MODULE COOLER

(75) Inventor: Charles R. Schenk, South Bend, IN (US)

(73) Assignee: Cummins, Inc., Columbus, IN (US)

( * ) Notice: Subject to any disclaimer, the term of this patent is extended or adjusted under 35 U.S.C. 154(b) by 22 days.

(21) Appl. No.: 10/611,096

(22) Filed: Jul. 1, 2003

(65) Prior Publication Data

US 2004/0050346 A1 Mar. 18, 2004

Related U.S. Application Data

(60) Provisional application No. 60/392,879, filed on Jul. 1, 2002.

(51) Int. Cl.[7] ..... F01P 1/06

(52) U.S. Cl. ..... 123/41.31; 165/80.4; 361/687

(58) Field of Search ..... 123/41.31; 165/41, 165/80.4; 361/687

(56) References Cited

U.S. PATENT DOCUMENTS

| | | | |
|---|---|---|---|
| 3,481,393 | A | 12/1969 | Chu |
| 3,623,546 | A | 11/1971 | Banthin et al. |
| 3,996,914 | A | 12/1976 | Crall et al. |
| 4,072,188 | A | 2/1978 | Wilson et al. |
| 4,557,225 | A | 12/1985 | Sagues et al. |
| 4,729,424 | A | 3/1988 | Mizuno et al. |
| 4,766,869 | A | 8/1988 | de Concini et al. |
| 4,893,590 | A | 1/1990 | Kashimura et al. |
| 5,070,849 | A | 12/1991 | Rich et al. |
| 5,105,875 | A | 4/1992 | McArthur |
| 5,117,932 | A | 6/1992 | Kurosu et al. |
| 5,207,186 | A | 5/1993 | Okita |
| 5,671,802 | A | 9/1997 | Rogers |
| 5,692,558 | A | 12/1997 | Hamilton et al. |
| 5,947,188 | A | 9/1999 | Nestvall |
| 5,964,206 | A | 10/1999 | White et al. |
| 5,988,119 | A | 11/1999 | Trublowski et al. |
| 6,302,190 | B1 | 10/2001 | Clamp et al. |
| 6,333,849 | B1 | 12/2001 | Donahoe et al. |

*Primary Examiner*—Noah P. Kamen
(74) *Attorney, Agent, or Firm*—Woodard, Emhardt, Moriarty, McNett & Henry LLP

(57) ABSTRACT

The present invention is directed toward a lift pump mounting bracket for an electronic control module cooler. In a preferred embodiment of the present invention, the lift pump is mounted directly to the ECM cooler by means of a pair of brackets which engage frustoconical-shaped grommets on either end of the lift pump. The grommets provide vibration dampening for the lift pump, while mounting the lift pump directly to the ECM cooler provides a convenient place for such mounting and, typically, ease of access should the lift pump need to be serviced. The frustoconical shapes of the mounting grommet allow the lift pump to be removed upon the disassembly of only a single one of the pair of mounting brackets, thereby making disassembly quicker and more convenient.

24 Claims, 4 Drawing Sheets

LIFT PUMP MOUNTING BRACKET FOR AN ELECTRONIC CONTROL MODULE COOLER

CROSS-REFERENCE TO RELATED APPLICATIONS

The present application claims priority under 35 U.S.C. §120 from U.S. Provisional patent application Ser. No. 60/392,879, filed Jul. 1, 2002.

TECHNICAL FIELD OF THE INVENTION

The present invention generally relates to internal combustion engines and, more particularly, to a lift pump mounting bracket for an electronic control module cooler.

BACKGROUND OF THE INVENTION

As is known in the art, it is common to utilize an electronic control module (ECM) in order to provide desired control functions for an internal combustion engine. Typically, the ECM receives inputs from various engine sensors, calculates a desired operating state of the engine based upon these inputs, and produces outputs which are operative to change the operating state of the engine.

Often, the ECM is mounted in the engine compartment of the vehicle, where high temperatures (both ambient and those produced by the combustion process of the engine) are somewhat incompatible with the sensitive electronic circuitry contained within the ECM. It is therefore known in the art to cool the ECM in various ways. In some prior art systems, the vehicle's anti-freeze or engine fuel is circulated through passages which are located adjacent the ECM. Because such liquid will absorb heat from the ECM as it passes thereby, the circulation of such liquid adjacent to the ECM serves to cool the ECM.

In order to circulate the cooling fluid, it is necessary to provide a pumping device in order to cause the liquid to flow. In some systems, an auxiliary lift pump is provided to supplement either the vehicle's fuel pump or water pump.

Because it should be anticipated that such a lift pump may eventually need to be serviced, it is desirable to find a convenient location to mount the pump. It is also desirable to find a convenient means to mount the pump such that it can be removed from the vehicle with a minimum of effort should servicing be required. The present invention is directed toward meeting this need.

SUMMARY OF THE INVENTION

The present invention is directed toward a lift pump mounting bracket for an electronic control module cooler. In a preferred embodiment of the present invention, the lift pump is mounted directly to the ECM cooler by means of a pair of brackets which engage frustoconical-shaped grommets on either end of the lift pump. The grommets provide vibration dampening for the lift pump, while mounting the lift pump directly to the ECM cooler provides a convenient place for such mounting and, typically, ease of access should the lift pump need to be serviced. The frustoconical shapes of the mounting grommet allow the lift pump to be removed upon the disassembly of only a single one of the pair of mounting brackets, thereby making disassembly quicker and more convenient.

DETAILED DESCRIPTION OF THE PREFERRED EMBODIMENTS

Figure 1:
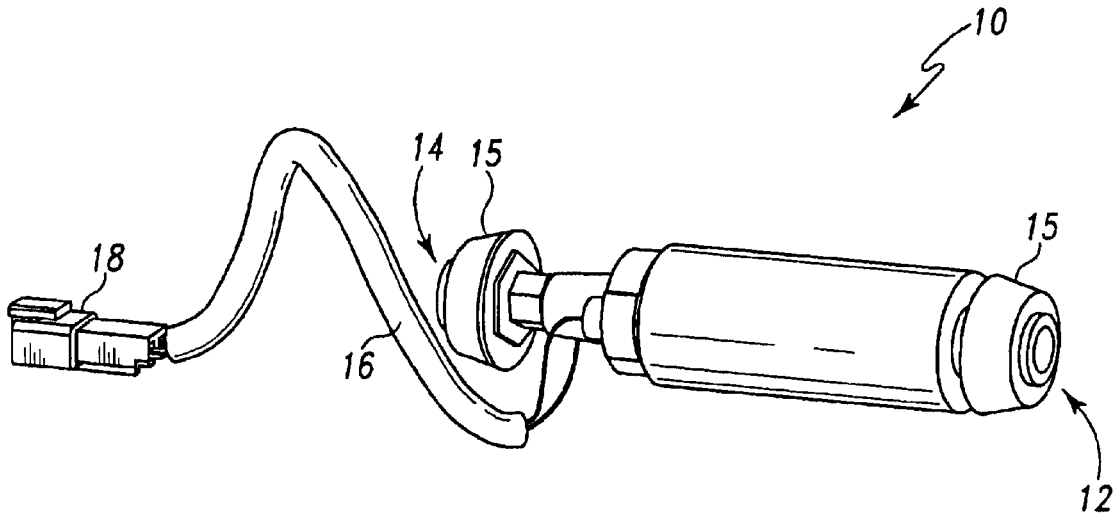
FIG. 1 is a perspective view of a preferred embodiment lift pump according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Referring now to FIG. 1, a lift pump according to a preferred embodiment of the present invention is illustrated, and indicated generally at 10. The lift pump 10 includes a cooling fluid inlet 12 and a cooling fluid outlet 14. The pumping action of the lift pump 10 causes fluid to be drawn into inlet 12 and expelled from outlet 14. The lift pump is powered by a pair of electrical wires 16 which preferably include a releasable connector interface 18 thereon. When the proper voltage is supplied to the wires 16, the lift pump 10 is caused to operate, thereby causing fluid to flow. The lift pump 10 includes two frustoconical grommets 15, one mounted adjacent the inlet 12 and one mounted adjacent the outlet 14. The smaller diameter of the frustoconical shape of each grommet faces the adjacent fluid port. Preferably, the grommets 15 are formed from a resilient material, such as rubber, which helps to isolate the lift pump 10 from vibration.

Figure 2:
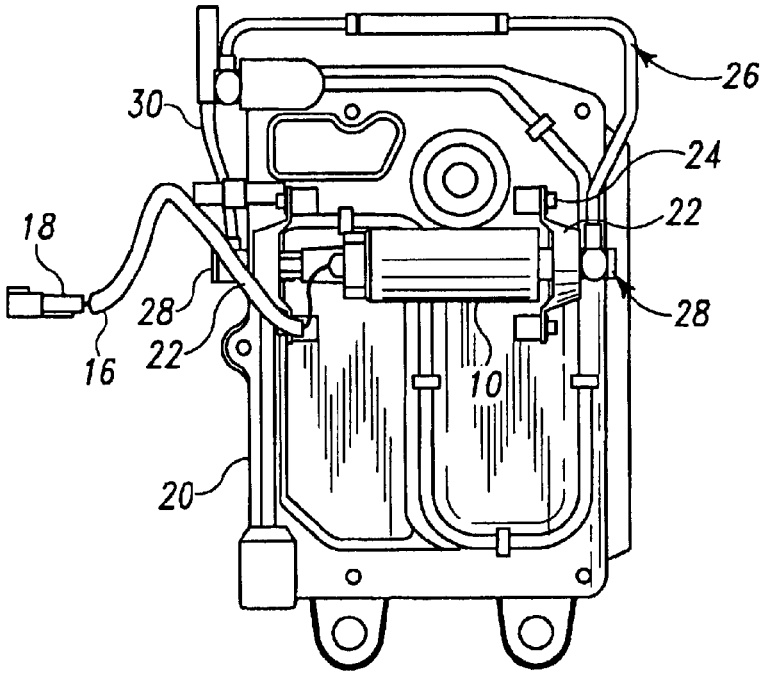
FIG. 2 is a side elevational view of the preferred embodiment lift pump of the present invention mounted to an ECM cooler.

Referring now to FIG. 2, the lift pump 10 is shown installed upon an ECM cooler 20. A pair of brackets 22 which generally conform to at least a portion of the surface of the frustoconical grommets 15 (not visible in FIG. 2) are attached to the ECM cooler by means of appropriate mounting hardware, such as the screws 24.

Figure 3:
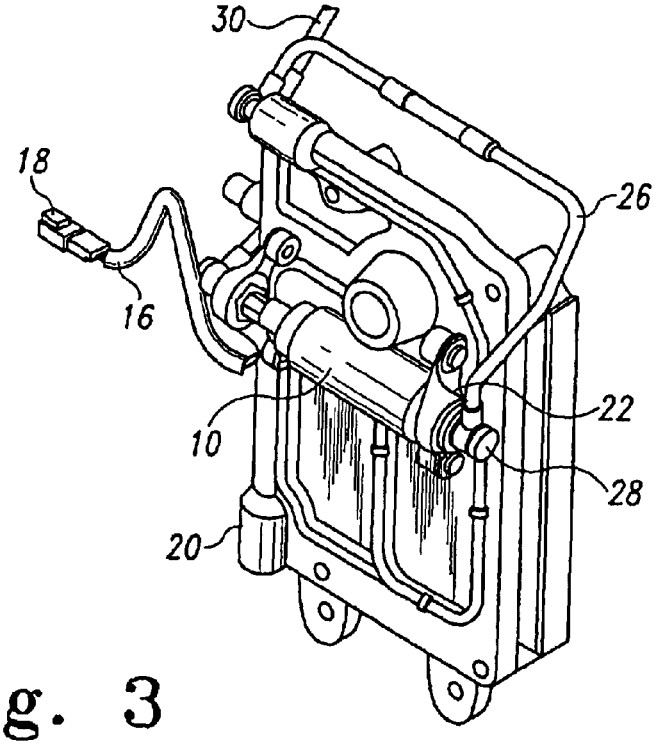
FIG. 3 is a perspective view of the preferred embodiment lift pump of the present invention mounted to the ECM cooler.

Fuel (or other cooling liquid) is provided to the inlet 12 by means of an inlet fuel line 26. Inlet fuel line 26 is coupled to the lift pump inlet 12 by any appropriate means, such as a first banjo bolt 28 which allows liquid to pass therethrough, as is known in the art. A fuel outlet line 30 is coupled to the lift pump outlet 14 by means of a second banjo bolt 28. The mounting system of FIG. 2 is shown from a perspective angle in the drawing of FIG. 3.

With reference now to FIGS. 4A-E, progressive steps in the unmounting of the lift pump 10 from the ECM cooler 20 are illustrated. In a first disassembly step, the banjo bolt 28 is removed from the lift pump outlet 14, thereby allowing removal of the outlet fuel line 30.

Figure 4A:
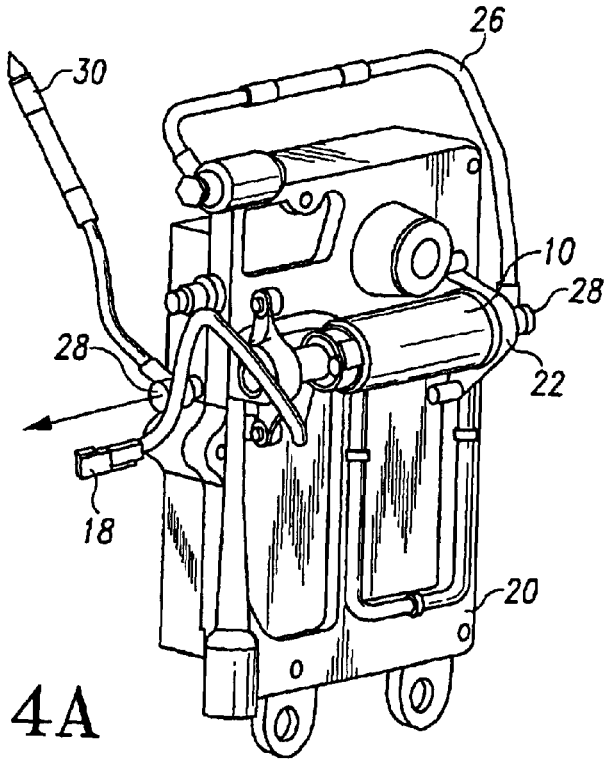
FIGS. 4A–E illustrate successive steps in the disassembly of the preferred embodiment lift pump of the present invention from its mounting location.
Figure 4B:
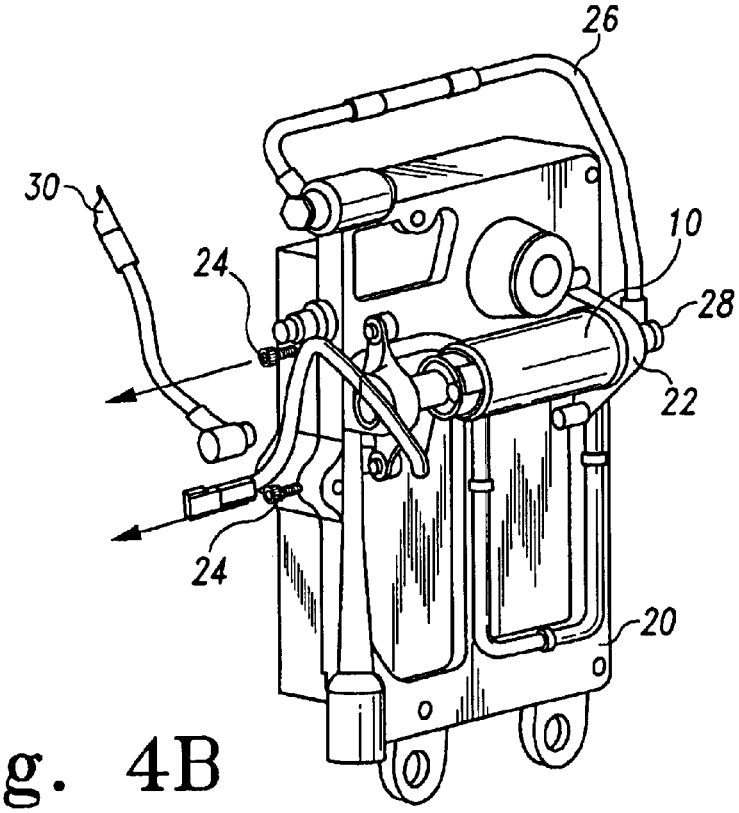
Figure 4C:
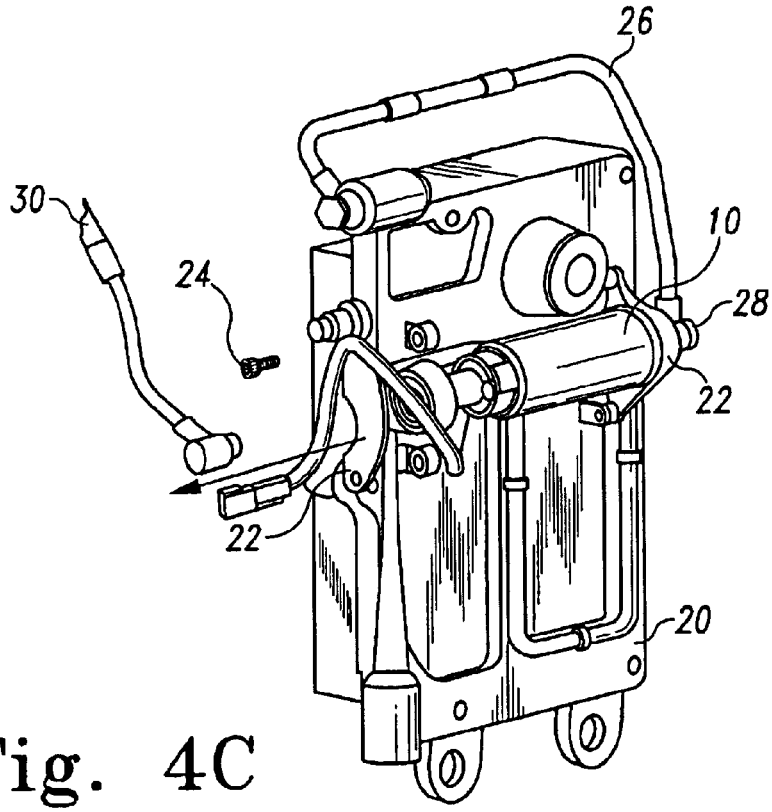

As shown in FIG. 4B, the screws 24 attaching the mounting bracket 22 on the lift pump outlet side are then removed. As shown in FIG. 4C, the mounting bracket 22 on the outlet side of the lift pump 10 may be removed once the mounting screws 24 have been removed. Removal of the outlet mounting bracket 22 leaves the lift pump 10 coupled to the ECM cooler 20 only by means of the inlet mounting bracket 22 and the inlet fuel line 26 banjo bolt 28.

Figure 4D:
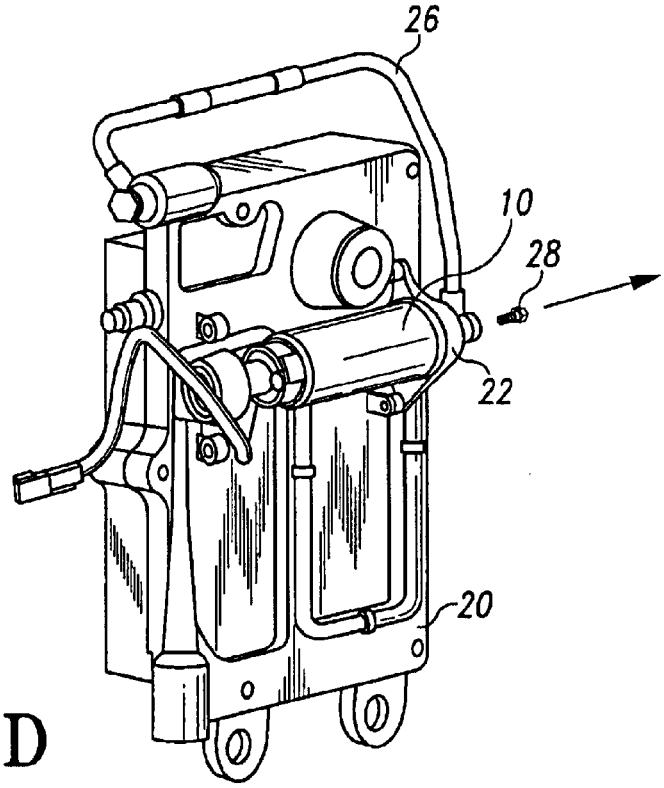
Figure 4E:
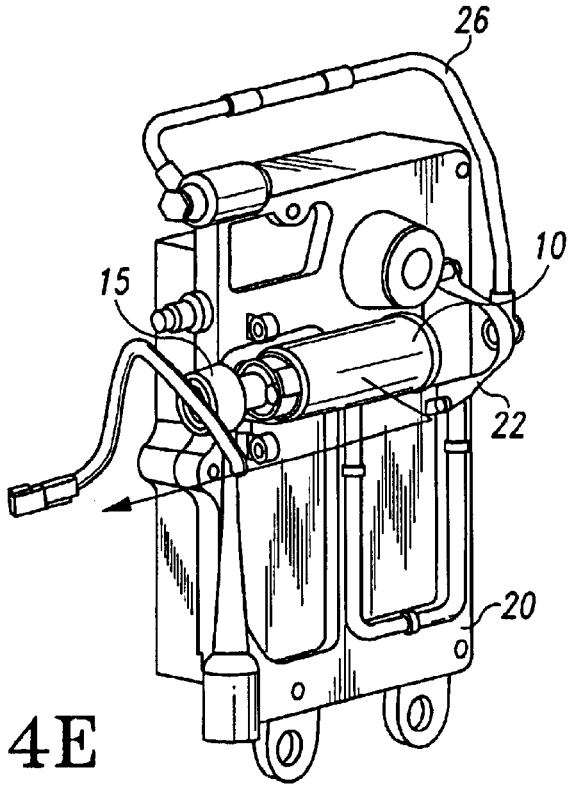

As shown in FIG. 4D, the banjo bolt 28 attaching the inlet fuel line 26 to the lift pump 10 is next removed, thereby disconnecting the inlet fuel line 26 from the lift pump 10. As shown in FIG. 4E, the lift pump 10 may now be slid out from under the mounting bracket 22 on the pump inlet side, at which point it is free from the ECM cooler 20.

It will be appreciated from the foregoing that the frustoconical shape of the lift pump 10 mounting grommets 15 allow the lift pump 10 to be removed from the ECM cooler 20 when only one of the mounting brackets 22 has been removed therefrom. Because the mounting brackets 22 are shaped to engage at least a portion of the frustoconical surface of the mounting grommets 15, they can easily be slid out from under a secured mounting bracket 22 once the pump is free to move along its longitudinal axis. Not only does this make removal of the lift pump 10 a much faster operation, but the mounting bracket 22, which remains coupled to the ECM cooler 20 provides a secure hold on the lift pump 10 at the beginning of the reassembly procedure, thereby greatly simplifying same. It will be appreciated by those having ordinary skill in the art that the reassembly procedure proceeds in the reverse order of the disassembly procedure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. An electronic control module assembly for an internal combustion engine, the assembly comprising:

an electronic control module (ECM);

an ECM cooler coupled to the ECM, the ECM cooler having a cooling passage inlet and a cooling passage outlet with a cooling passage therebetween for circulating a cooling fluid;

a lift pump comprising:

a pump inlet;

a pump outlet;

wherein the lift pump is operative to draw cooling fluid into the pump inlet and expel the cooling fluid from the pump outlet;

an inlet cooling fluid line coupled to the pump inlet;

an outlet cooling fluid line coupled to the pump outlet;

wherein one of the inlet cooling fluid line and outlet cooling fluid line are coupled to one of the cooling passage outlet and cooling passage inlet for cooling fluid flow therebetween;

a first frustoconical grommet mounted to the lift pump adjacent the pump inlet, the first frustoconical grommet having a first end with a first diameter and a second end with a second diameter, wherein the first diameter is smaller than the second diameter and wherein the first end is closer to the pump inlet than the second end;

a second frustoconical grommet mounted to the lift pump adjacent the pump outlet, the second frustoconical grommet having a third end with a third diameter and a fourth end with a fourth diameter, wherein the third diameter is smaller than the fourth diameter and wherein the third end is closer to the pump outlet than the fourth end;

a first bracket mounted to the ECM cooler and engaging the first frustoconical grommet, the first bracket shaped to conform to at least a portion of the first frustoconical grommet; and a second bracket mounted to the ECM cooler and engaging the second frustoconical grommet, the second bracket shaped to conform to at least a portion of the second frustoconical grommet;

wherein the lift pump can be disengaged from the ECM cooler by removing one of the first bracket and the second bracket and removing one of the inlet cooling fluid line and the outlet cooling fluid line.

2. The electronic control module assembly of claim 1, wherein the lift pump comprises an electric lift pump.

3. The electronic control module assembly of claim 1, further comprising:

a banjo bolt coupling the inlet cooling fluid line to the pump inlet.

4. The electronic control module assembly of claim 1, further comprising:

a banjo bolt coupling the outlet cooling fluid line to the pump outlet.

5. The electronic control module assembly of claim 1, further comprising:

a cooling fluid contained in the cooling fluid passage.

6. The electronic control module assembly of claim 5, wherein the cooling fluid comprises fuel.

7. The electronic control module assembly of claim 1, wherein the first and second frustoconical grommets are formed from rubber.

8. An electronic control module assembly for an internal combustion engine, the assembly comprising:

an electronic control module (ECM);

an ECM cooler coupled to the ECM, the ECM cooler having a cooling passage inlet and a cooling passage outlet with a cooling passage therebetween for circulating a cooling fluid;

a lift pump comprising:

a pump inlet;

a pump outlet;

wherein the lift pump is operative to draw cooling fluid into the pump inlet and expel the cooling fluid from the pump outlet;

a first frustoconical grommet mounted to the lift pump adjacent the pump inlet, the first frustoconical grommet having a first end with a first diameter and a second end with a second diameter, wherein the first diameter is smaller than the second diameter and wherein the first end is closer to the pump inlet than the second end;

a second frustoconical grommet mounted to the lift pump adjacent the pump outlet, the second frustoconical grommet having a third end with a third diameter and a fourth end with a fourth diameter, wherein the third diameter is smaller than the fourth diameter and wherein the third end is closer to the pump outlet than the fourth end;

a first bracket mounted to the ECM cooler and engaging the first frustoconical grommet, the first bracket shaped to conform to at least a portion of the first frustoconical grommet; and a second bracket mounted to the ECM cooler and engaging the second frustoconical grommet, the second bracket shaped to conform to at least a portion of the second frustoconical grommet;

wherein the lift pump can be disengaged from the ECM cooler by removing one of the first bracket and the second bracket.

9. The electronic control module assembly of claim 8, further comprising:

an inlet cooling fluid line coupled to the pump inlet; and an outlet cooling fluid line coupled to the pump outlet;

wherein one of the inlet cooling fluid line and outlet cooling fluid line are coupled to one of the cooling passage outlet and cooling passage inlet for cooling fluid flow therebetween; and wherein the lift pump can be disengaged from the ECM cooler by removing one of the first bracket and the second bracket and removing one of the inlet cooling fluid line and the outlet cooling fluid line.

10. The electronic control module assembly of claim 9, further comprising:

a banjo bolt coupling the inlet cooling fluid line to the pump inlet.

11. The electronic control module assembly of claim 9, further comprising:

a banjo bolt coupling the outlet cooling fluid line to the pump outlet.

12. The electronic control module assembly of claim 8, wherein the lift pump comprises an electric lift pump.

13. The electronic control module assembly of claim 8, further comprising:

a cooling fluid contained in the cooling fluid passage.

14. The electronic control module assembly of claim 13, wherein the cooling fluid comprises fuel.

15. The electronic control module assembly of claim 8, wherein the first and second frustoconical grommets are formed from rubber.

16. An electronic control module assembly for an internal combustion engine, the assembly comprising:

an electronic control module (ECM);

an ECM cooler coupled to the ECM, the ECM cooler having a cooling passage inlet and a cooling passage outlet with a cooling passage therebetween for circulating a cooling fluid;

a lift pump comprising:

a pump inlet;

a pump outlet;

wherein the lift pump is operative to draw cooling fluid into the pump inlet and expel the cooling fluid from the pump outlet;

a first frustoconical grommet mounted to the lift pump adjacent one of the pump inlet and pump outlet, the first frustoconical grommet having a first end with a first diameter and a second end with a second diameter, wherein the first diameter is smaller than the second diameter and wherein the first end is closer to said one of the pump inlet and the pump outlet than the second end;

a second grommet mounted to the lift pump adjacent another one of the pump inlet and the pump outlet;

a first bracket mounted to the ECM cooler and engaging the first frustoconical grommet, the first bracket shaped to conform to at least a portion of the first frustoconical grommet; and a second bracket mounted to the ECM cooler and engaging the second grommet;

wherein the lift pump can be disengaged from the ECM cooler by removing the second bracket.

17. The electronic control module assembly of claim 16, wherein:

the second grommet is frustoconical in shape;

the second grommet has a third end with a third diameter and a fourth end with a fourth diameter;

the third diameter is smaller than the fourth diameter; and the third end is closer to the pump outlet than the fourth end.

18. The electronic control module assembly of claim 17, further comprising:

an inlet cooling fluid line coupled to the pump inlet; and an outlet cooling fluid line coupled to the pump outlet;

wherein one of the inlet cooling fluid line and outlet cooling fluid line are coupled to one of the cooling passage outlet and cooling passage inlet for cooling fluid flow therebetween; and wherein the lift pump can be disengaged from the ECM cooler by removing one of the first bracket and the second bracket and removing one of the inlet cooling fluid line and the outlet cooling fluid line.

19. The electronic control module assembly of claim 18, further comprising:

a banjo bolt coupling the inlet cooling fluid line to the pump inlet.

20. The electronic control module assembly of claim 18, further comprising:

a banjo bolt coupling the outlet cooling fluid line to the pump outlet.

21. The electronic control module assembly of claim 17, wherein the first and second frustoconical grommets are formed from rubber.

22. The electronic control module assembly of claim 16, wherein the lift pump comprises an electric lift pump.

23. The electronic control module assembly of claim 16, further comprising:

a cooling fluid contained in the cooling fluid passage.

24. The electronic control module assembly of claim 23, wherein the cooling fluid comprises fuel.

* * * * *